US008500576B2

(12) United States Patent
Walker, Jr.

(10) Patent No.: US 8,500,576 B2
(45) **Date of Patent: *Aug. 6, 2013**

(54) WAIST-MOUNTED TETHERED BALL AND TARGET

(71) Applicant: Wilmer David Walker, Jr., Atlanta, GA (US)

(72) Inventor: Wilmer David Walker, Jr., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/721,001

(22) Filed: Dec. 19, 2012

(65) Prior Publication Data

US 2013/0106058 A1 May 2, 2013

Related U.S. Application Data

(63) Continuation of application No. 12/952,455, filed on Nov. 23, 2010, now Pat. No. 8,366,571.

(60) Provisional application No. 61/263,729, filed on Nov. 23, 2009.

(51) Int. Cl.
*A63B 67/10* (2006.01)

(52) U.S. Cl.
USPC ..... 473/507; 473/506

(58) Field of Classification Search
USPC ..... 273/317, 329–331, 348, 398–402, 273/DIG. 19; D21/303, 305; 473/506, 507
See application file for complete search history.

(56) References Cited

U.S. PATENT DOCUMENTS

| | | | | | |
|---|---|---|---|---|---|
| 2,488,919 | A | | 11/1949 | Mansfield | |
| 2,570,860 | A | | 10/1951 | Redding | |
| 3,610,622 | A | * | 10/1971 | Haroski | 273/412 |
| D226,770 | S | | 4/1973 | Prischak et al. | |
| 3,774,910 | A | * | 11/1973 | Walker, Jr. | 273/412 |
| 3,782,727 | A | * | 1/1974 | Chirnomas | 273/334 |
| 3,936,051 | A | * | 2/1976 | Walker, Jr. | 273/412 |
| D239,648 | S | * | 4/1976 | Somsky | D21/466 |
| 4,000,898 | A | | 1/1977 | Cooter | |
| 4,013,292 | A | * | 3/1977 | Cohen et al. | 273/371 |
| 4,059,271 | A | * | 11/1977 | Dupre | 473/576 |
| D248,585 | S | | 7/1978 | Lincoln | |
| 4,248,435 | A | * | 2/1981 | Barmore | 273/412 |
| 4,274,639 | A | * | 6/1981 | Flanders | 273/402 |
| D285,811 | S | | 9/1986 | Donahoe | |
| 4,744,563 | A | * | 5/1988 | Anastasia et al. | 273/116 |

(Continued)

FOREIGN PATENT DOCUMENTS

| | | |
|---|---|---|
| WO | WO 2004/112919 | 12/2004 |
| WO | WO 2011/063393 | 5/2011 |

*Primary Examiner* — Raleigh W Chiu
(74) *Attorney, Agent, or Firm* — Gaylon Hollis

(57) ABSTRACT

A game device has a target plate fixed to the waist area of a person who will play the game, and a ball is tethered to the target plate. The tether is flexible to allow the ball to engage a target on the target plate. To facilitate control of the ball on the tether, the tether has a rigid rod flexibly fixed to the bottom of the target plate, and a flexible string extending from the rod to the ball. There are sights between the targets on the target plate. By swinging the tethered ball with the tether aligned with a sight, the player can align the ball to be received by a target. Baskets in the targets catch the ball, so the ball can be easily removed from the target. Electronic play instructions, electronically directed game play, electronic scorekeeping means, and electronically directed alternative player goals are provided.

19 Claims, 8 Drawing Sheets

U.S. PATENT DOCUMENTS

| | | | | | |
|---|---|---|---|---|---|
| 4,911,432 | A | * | 3/1990 | Walden | 482/148 |
| 5,163,680 | A | * | 11/1992 | Amron | 273/371 |
| 5,244,206 | A | * | 9/1993 | Clark et al. | 273/118 R |
| 5,249,810 | A | * | 10/1993 | Cazalet | 273/330 |
| 5,286,031 | A | * | 2/1994 | Walker, Jr. | 473/507 |
| 5,348,307 | A | * | 9/1994 | Duggan | 473/507 |
| 5,377,996 | A | * | 1/1995 | Shure | 273/330 |
| 5,405,149 | A | * | 4/1995 | Allen | 273/330 |
| D365,128 | S | | 12/1995 | Testasecca et al. | |
| 5,722,662 | A | | 3/1998 | Howell | |
| 6,910,977 | B2 | * | 6/2005 | Baquero | 473/518 |
| 6,991,509 | B1 | * | 1/2006 | Carley et al. | 446/175 |
| 7,641,199 | B1 | * | 1/2010 | Clarke | 273/330 |
| 8,366,571 | B2 | | 2/2013 | Walker, Jr. | |

* cited by examiner 34
35
36
38
39
40

10
20a
74
50
20
20b
12
11
55
60
15
65
72
14
58
70
22
16
24
60
21

30
30
18
18
31
31
19
19

WAIST-MOUNTED TETHERED BALL AND TARGET

CROSS-REFERENCE TO RELATED APPLICATION

This application claims priority under 35 U.S.C §119 to U.S. non-provisional patent application Ser. No. 12/952,455, filed on Nov. 23, 2010, now U.S. Pat. No. 8,366,571 , Issued Feb. 5, 2013, which claimed priority to U.S. provisional patent application. Ser. No. 61/263,729, filed on Nov. 23, 2009, both entitled "Waist-Mounted Tethered Ball and Target," both of which are herein incorporated by reference in their entirety.

TECHNICAL FIELD

The subject matter hereof relates, generally, to recreational games and, more particularly, to waist-mounted games having a tethered ball to be received by a target, and including electronic play instructions, electronically directed game play, electronic scorekeeping means, and electronically directed alternative player goals.

BACKGROUND

There are several prior art games wherein a tethered ball is manipulated by the body to engage a target. One prior art game is disclosed in U.S. Pat. Nos. 3,774,910 and 5,286,031, both of which issued to the inventor of the present subject matter, the disclosures of which are incorporated herein by reference. The present subject matter relates to, and constitutes an improvement over, the games disclosed in the above-mentioned patents.

U.S. Pat. No. 3,774,910 (the '910 patent) includes a target plate comprising a plurality of holes for selectively receiving a ball. The ball may be tethered to a member carried by the body of a different person; however, it is also suggested therein that the ball may be tethered to the target plate, so that one person can play the game. The tether for the ball is a member that is flexible throughout its length, so it is quite difficult to control the ball, and there are no visual cues to assist a player in causing the ball to be received by the intended target. The game disclosed in the '910 patent is, therefore, very difficult, and success tends to be more related to probability than to skill or attention by the player.

U.S. Pat. No. 5,286,031 (the '031 patent) provides an improvement over the '910 patent by providing a waist mounted game having a target plate, and a ball tethered to the target plate. The target plate includes at least one target for receiving the ball. In the preferred embodiment, the target plate includes a plurality of holes, each hole being of a different diameter for presenting a different level of difficulty in receiving the ball, and there are sighting means between adjacent holes. In one form of the game, the holes of the target plate have baskets to receive the ball so the ball is easily removable therefrom. The tether for the ball includes a first length that is generally rigid, and a second length that is flexible. The first length acts as a means for controlling and directing the ball, and the second length allows freedom for the ball to engage a target on the target plate, or not. By utilizing the sighting means for directing the motion of the first length of the tether, one can increase the probability of having the ball received by a target on the target plate. Thus, the game disclosed in the '031 patent provides for greater control over the ball and, therefore, enables the player to develop and demonstrate greater accuracy and skill during game play. Through practice, a player's competitiveness can increase, which is most significant in multiplayer games.

In both the '910 and the '031 patents, the player is tasked with his or her own scorekeeping. For some players, however, this may be unacceptable, inconvenient, or impossible. For example, for younger children, who may not yet have developed sufficient skill in mathematics to easily keep score, for players who may become confused or forgetful in keeping increasing score tallies, for multiplayer games wherein players may not trust manual scorekeeping, and for players who simply do not feel adept at keeping score, a manual scorekeeping process becomes an impediment to full enjoyment of play and competition. For such players, and in such circumstances, an electronic scorekeeping means may prove beneficial.

Yet additionally, some players may better enjoy the game apparatus when provided with challenges in the form of electronically directed game-play. Such directed challenges may serve to increase basic game skills, to provide diversity in play, and to demonstrate forms of play that can lead to enhancements in player creativity during play.

Accordingly, it would be beneficial to provide players with an improved waist-mounted tethered ball and target including electronic play instructions, electronically directed game-play, electronic scorekeeping means, and electronically directed alternative player goals, in order to increase such players' feelings of fun, pleasure, and satisfaction with their game play.

SUMMARY

An improved waist-mounted game is provided that has a target plate, and a ball tethered to the target plate. The target plate includes at least one target and basket for receiving the ball. The tether for the ball includes a first length that is generally rigid, and a second length that is flexible. The first length acts as a means for directing and controlling the ball, and the second length allows freedom for the ball to engage a target on the target plate, or not. The target plate also may include sighting means for cooperation with the first length of the tether. By utilizing the sighting means for directing the motion of the first length of the tether, one can increase the probability of having the ball received by a target on the target plate.

Further provided within the subject matter of the present invention may be electronic play instructions, electronically directed game play, electronic scorekeeping means, and electronically directed alternative player goals. Consistent with, and in order to provide such functionality, an electronics module is disposed within a compartment of the target plate stem. The electronics module provides a microprocessor and associated, supporting circuitry. Sensor means are provided in association with each target in order to detect when the ball is received within the target.

The microprocessor is preconfigured with coded instructions providing electronic play instructions, electronically directed game play, electronic scorekeeping means, and electronically directed alternative player goals. A display is provided in order to allow the player to view his or her interactions with the microprocessor, and to receive instructions, in graphical and/or textual form, from the microprocessor. Control means are provided to allow the player to access the microprocessor functions. A sound speaker is provided in order to deliver one or more preprogrammed sounds to the user. A portion of the compartment further provides space for connecting and carrying a battery to power the microprocessor and other electronic components, including the speaker, the display, and the sensor means.

BRIEF DESCRIPTION OF THE DRAWINGS

These and other features and advantages of the subject matter of the present invention will become apparent from consideration of the following specification when taken in conjunction with the accompanying drawing Figures in which like reference numbers throughout the various drawing Figures designate like structure, and in which.

Figures 1, 6:
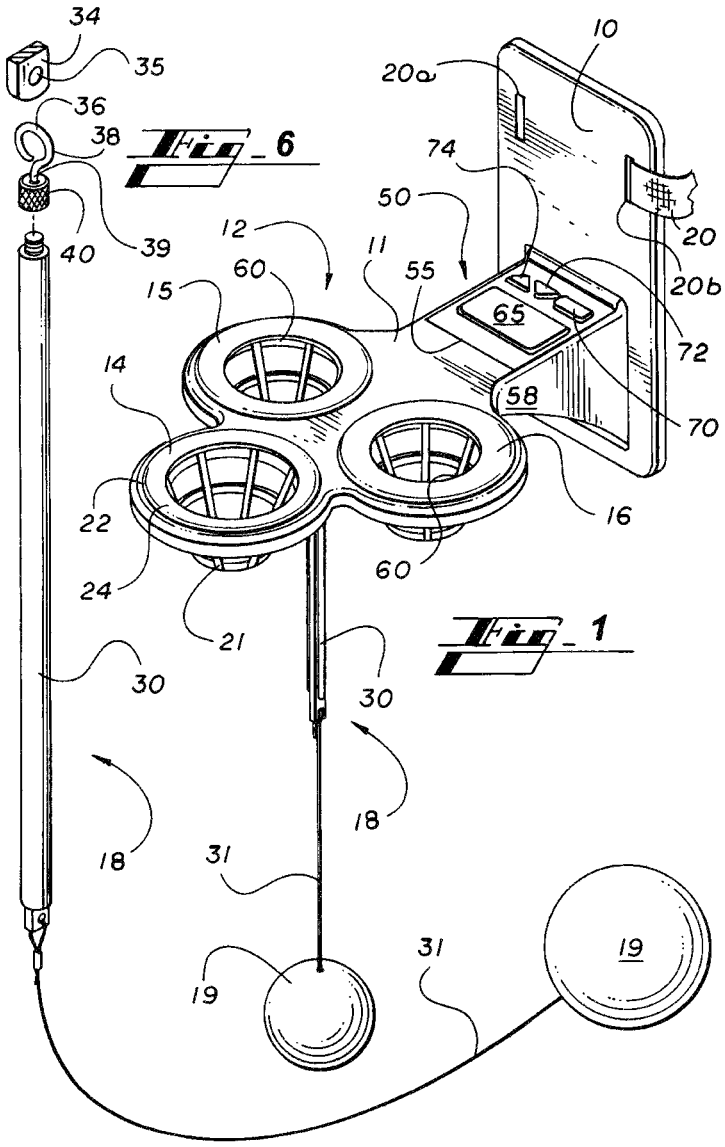
FIG. 1 is a perspective view showing a tethered ball and target made in accordance with the present subject matter.
FIG. 6 is a partial fragmentary view of the tether and ball of the device shown in FIG. 1.

It is to be noted that the drawing Figures presented are intended solely for the purpose of illustration and that they are, therefore, neither desired nor intended to limit the subject matter of the claimed invention to any or all of the exact details of construction shown, except insofar as they may be deemed essential to the claimed invention.

DETAILED DESCRIPTION OF ILLUSTRATIVE EMBODIMENTS

In describing preferred embodiments of the subject matter of the present invention, as illustrated in the drawing Figures, specific terminology is employed for the sake of clarity. The claimed subject matter, however, is not intended to be limited to the specific terminology so selected, and it is to be understood that each specific element includes all technical equivalents that operate in a similar manner to accomplish a similar purpose.

Referring now more particularly to the drawing Figures, and to that embodiment of the invention here presented by way of illustration, FIG. 1 illustrates a device made in accordance with the subject matter of the present invention. As shown in FIG. 1, the game device includes base board 10 having stem 11 extending therefrom and carrying target means generally designated at 12. As here shown, target means comprising, for example, target plate 12, includes three targets designated at 14, 15 and 16. Tether 18 depends from target plate 12, tether member 18 carrying ball 19 at its extending end.

Those skilled in the art will realize that, from looking at the '910 and the '031 patents, base board 10 will be placed against the waist, or abdominal area, of a player, and fixed thereto by means of strap 20 threaded through slots 20*a*, 20*b*. Stem 11 will then project away from the body of the player, carrying target plate 12 at the end of stem 11. Ball 19 hangs below target plate 12, and the object of the game is for the player to manipulate his or her body in such a way as to cause ball 19 to be received by one of targets 14, 15 and 16 on target plate 12. In the device disclosed in the '910 patent, it will be realized that the entire tether is a flexible member so that the player has no real control of the motion of ball 19. Also, in the device disclosed in the '910 patent, when the ball is received by one of the targets, or holes, of the target plate, the ball falls completely through the hole, and must be retrieved by pulling the string to cause the ball to pass through the hole, or physically grasping the ball and urging it back through the hole of the target plate.

In the present invention, means are provided for allowing the player to control and direct the motion of ball 19 for more easily causing ball 19 to be received by one of the targets on target plate 12. Also, it is contemplated that the game of the present invention will be played without the use of the player's hands. As a result, baskets or other receiving means are placed within targets 14, 15 and 16, so that ball 19 will not pass completely through a hole, and will not require the use of hands to remove ball 19 from the target.

With continued attention to FIG. 1 of the drawings, specifically, and to FIGS. 1-6, generally, it will be seen that there is a frustoconical basket designated at 21, the larger end of basket 21 being received within opening 22 of target plate 12. Ring 24 secures basket 21 to target plate 12, ring 24 being secured to target plate 12 by any means of construction, including hooks, adhesives, or the like.

Figure 2:
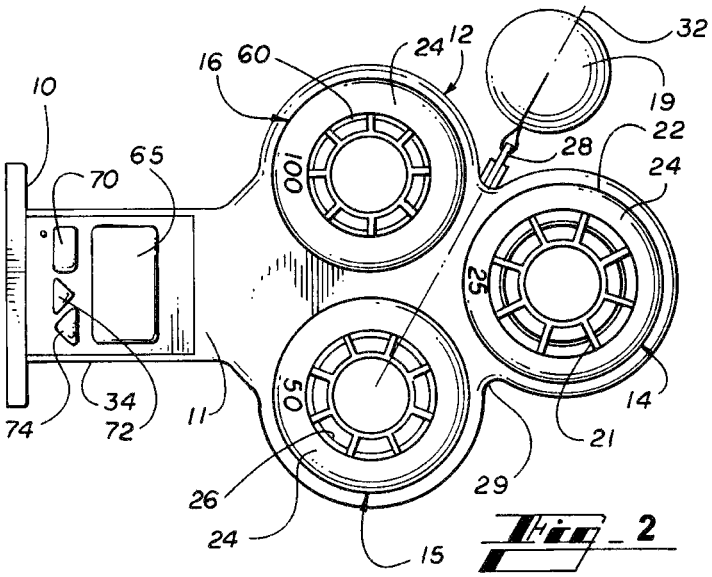
FIG. 2 is a top view of the device shown in FIG. 1.
Figure 3:
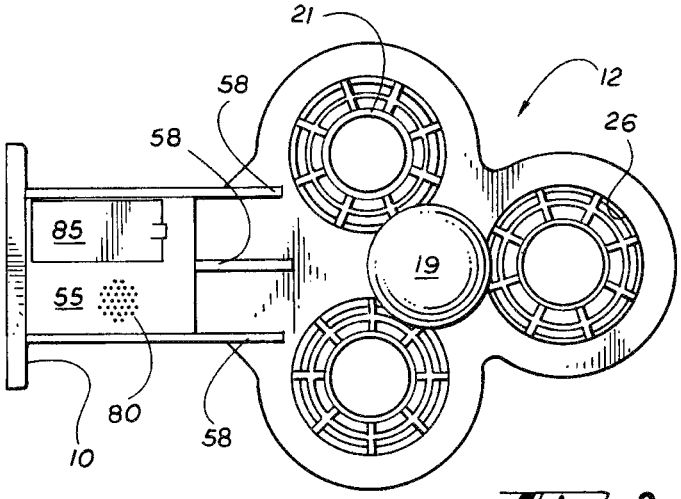
FIG. 3 is a bottom view of the device shown in FIG. 1.

With attention to FIGS. 1-3 of the drawings, it will be understood that all holes 22 in target plate 12 are the same size for targets 14, 15, and 16. Ring 24, however, presents different sizes of central openings for each target 14, 15, and 16. Central opening 26 of target 14, best seen with reference to FIG. 2 of the drawings is the largest of targets 14, 15, and 16. Rings 24 for holes 15 and 16 have smaller central openings 26.

With the basket arrangement as described, and as shown in FIGS. 2-3 of the drawings, it will be readily understood that ball 19 can be received through central opening 26, and will be received by basket means 21. Lower end of the basket means 21 is considerably smaller than ball 19, so ball 19 will be held by basket 21.

In FIG. 2, it will be further noted that there are sighting means designated at 28 and 29. Sighting means 28 and 29 will be discussed in more detail below.

Considering FIGS. 1 and 6, it will be noted that tether 18 includes first length 30 comprising a generally rigid member. Length 30 is made of a rod-like material that is suspended from target plate 12. As illustrated in FIG. 1, length 30 extends generally vertically downwardly, and is connected to second length 31. Length 31 comprises a string, wire, filament, or the like that is completely flexible throughout its length.

Figures 4, 5:
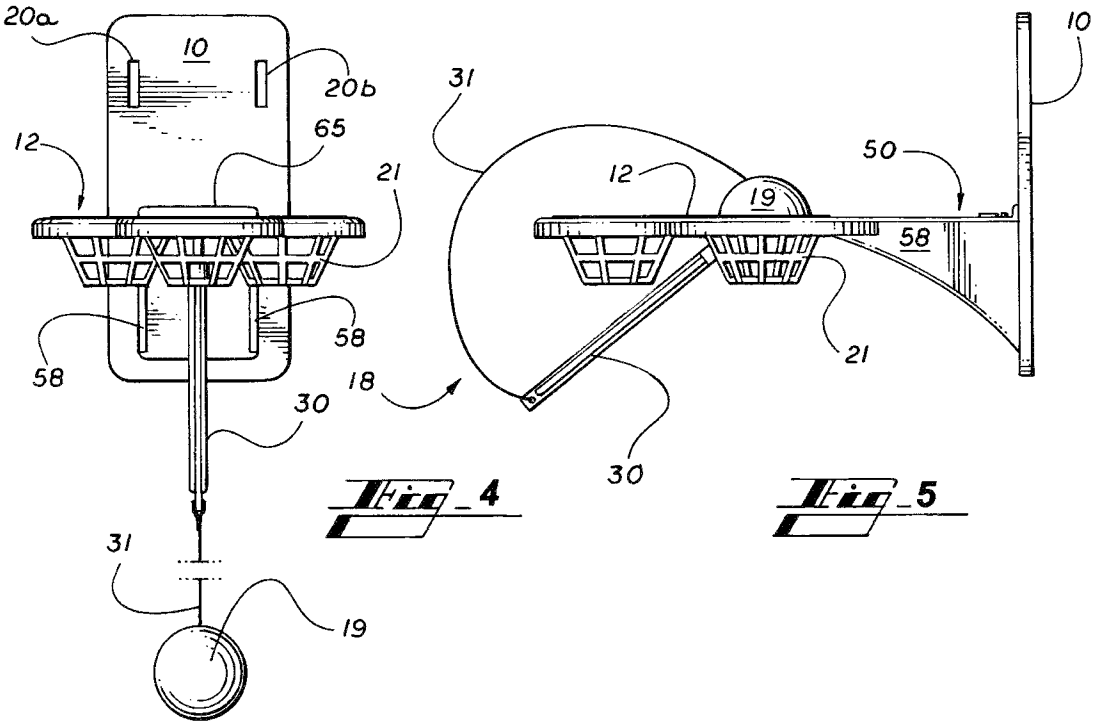
FIG. 4 is a front elevation view of the device shown in FIG. 1, also showing the connection of the tether to the target plate.
FIG. 5 is a side view of the device shown in FIG. 1, also showing the ball in a scoring position.
Figure 6A:
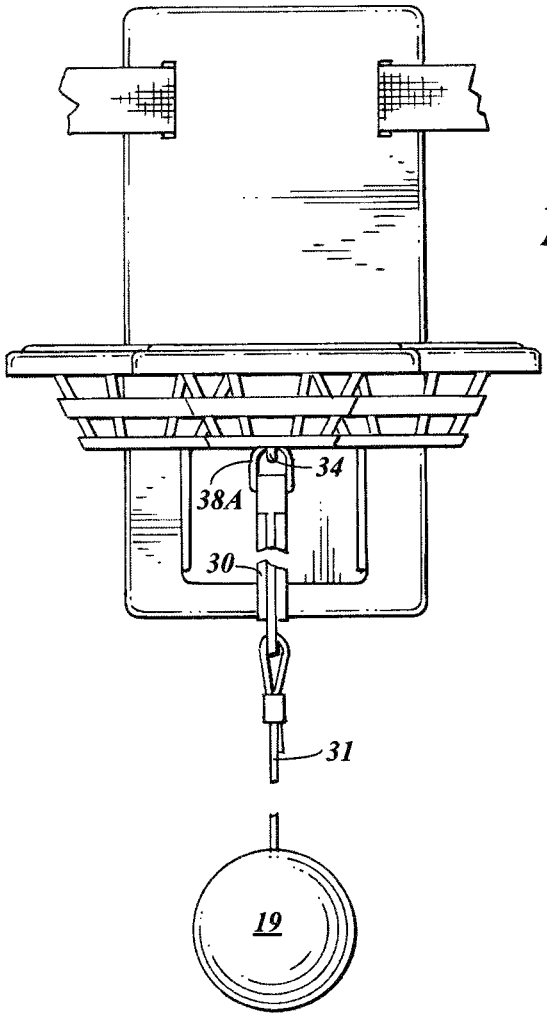
FIG. 6A is an alternative embodiment of a partial fragmentary view of the tether and ball of the device shown in FIG. 1.

Turning attention to FIGS. 2, 4, and 5 of the drawings, it will be understood that the player of the game will manipulate his body so that tether 18 begins to swing. As tether 18 swings, the player will look downwardly on target plate 12, and view tether 18 through sight (for example) 28. Further, considering FIG. 2 of the drawings, it will be noted that there is centerline 32 that extends generally from the center of target 15, along the centerline of length 30, and along the center of length 31 of tether 18. As a result, by swinging tether 18 so that the centerline of tether 18 is aligned with centerline 32, ball 19 is in position to move into target 15 of target plate 12.

Those skilled in the art will realize that, by reversing the body motion, tether 18 will, swing in the opposite direction and be aligned with sighting means 29. Such action will align ball 19 to be received by target 16.

Referring now to FIGS. 3, 4, 6, and 6A of the drawings, it will be understood that tether 18 must be suspended from target means 12 in such fashion that tether 18 can move in any direction. Those skilled in the art will devise numerous mechanical arrangements for providing such motion, but one very simple and effective mechanical arrangement is illustrated in FIG. 6 of the drawings. It will be seen that there is a support protrusion 34 that depends from target plate 12. Generally centrally of target means 12, protrusion 34 is provided with hole 35. Hole 35 receives curved portion 36 of a narrowly open, approximately circularly-shaped ring and hook arrangement, generally designated at 38. Straight portion 39 of ring 38 extends into a threaded cap 40 affixed to length 30 of tether 18. In an alternative embodiment, this construction may be provided as a single-piece unit; to wit, curved portion 36, ring 38, straight portion 39, and length 30 may be of unitary construction. In another alternative embodiment, such as shown in FIG. 6B, D-ring 38A serves to replace ring and hook arrangement 38 of FIG. 6. In this embodiment, open ends of D-ring 38A are received into a hole formed within the end of length 30, the construction being in lieu of the threaded cap arrangement demonstrated within FIG. 6.

With the above described configuration, and further advantageously in view of the construction of the web-affixed arrangement of the '031 patent, wherein binding of the tether against the web and/or the D-ring could occur, it will be readily understood that tether 18 can swing in one direction, and curved portion 36 of ring 38 can move back and forth through hole 35 in protrusion 34, all without binding. It will therefore be readily understood that the combination of these motions provides a connection with multiple degrees of freedom of tether 18 with respect to protrusion 34.

In view of the above and foregoing discussion, it should now be understood that the device of the present invention provides a game wherein one player can attempt to manipulate target plate 12 and attached tether 18 to cause ball 19 to be received by one of the targets on target plate 12. It is contemplated that individual targets 14, 15, and 16 in target plate 12 will be of different colors, and preferably labeled with a particular number to indicate the points allotted for having ball 19 received by that particular target. As herein indicated, the points are 25 points for hole 14, 50 points for hole 15 and 100 points for hole 16. Thus, an individual can play alone and keep score in an effort for self improvement. Alternatively, two or more persons can play the game in competitive fashion, the one receiving more points in a given length of time being declared the winner.

Further, there are many variations that can be made in playing the game of the present invention. One might play simply for the greatest number of points in a given time period, or one might require that ball 19 be received by targets 14, 15, and 16 in a particular sequence. In the latter form of the game, by way of example, one will be required to place ball 19 in target 14 first, then to place to place ball 19 in target 15, and subsequently in target 16. With this set of rules, if the ball is first placed in target 16, the score will not count and the player will still have to place ball 19 in target 14. Many other variations will suggest themselves to those skilled in the art.

In support of some of these variations, to provide additional scorekeeping functionality, and in order to enhance the player's overall experience, the subject matter of the present invention includes electronic play instructions, electronically directed game-play, electronic scorekeeping means, and electronically directed alternative player goals. Such functionality is provided in order to increase each players' pleasure and satisfaction with their game play.

Consistent with, and in order to provide such functionality, electronics module 50 is disposed within compartment 55 of target plate stem 11. Electronics module 50 provides a microprocessor and associated, supporting circuitry for the purposes described hereinbelow. Best seen with reference to FIG. 3, for support of compartment 55 and its contents, stiffening webs 58 are provided between target plate 12 and compartment 55.

Additionally, sensor means 60 are provided in operable association with each target 14, 15, 16 in order to detect when ball 19 is received within a target. Sensor means 60 may include, for example and without limitation, switches, contacts, flux sensors, stress/strain sensors, or the like, individually or in operable combinations. When ball 19 passes into one of targets 14, 15, or 16, sensor means 60 is electrically energized. A corresponding signal, identifying the appropriate target, is sent to electronics module 50 for further processing.

In processing the signal, electronics module 50 is preprogrammed to identify the target and the corresponding point value thereof. In a simple configuration, electronics module 50 may increment a score value and subsequently present that value upon display 65. In more complex configurations, electronics module 50 may further process that signal in a manner consistent with the pre-programmed functionality described further hereinbelow.

Accordingly, display 65 is provided in order to allow the player to view his or her interactions with the microprocessor, and to receive instructions, in graphical and/or textual form, from the microprocessor. Control means 70, 72, 74 are provided to allow the player to access the microprocessor functions. Display 65 and control means 70, 72, 74 are preferably located upon stem 11 for ease of visibility, access and use during play. Control means 70 may be preprogrammed provide start and stop functionality, to turn on and off electronics module 50, to turn on and off speaker 80, or the like. Similarly, control means 72, 74 may provide for advancing or stepping through menu options provided by electronics module 50, for incrementing or decrementing speaker volume, for incrementing or decrementing game score values, or the like.

Best seen with reference to FIG. 3, sound speaker 80 is provided in order to deliver one or more preprogrammed sounds to the player. A portion of compartment 55 further provides space for connecting and carrying a battery to power the microprocessor and other electronic components, including speaker 80, display 65, and sensor means 60. This portion of compartment 55 is preferably accessible through battery cover 85.

As discussed hereinabove, the microprocessor is preconfigured with coded instructions providing electronic play instructions, electronically directed game play, electronic scorekeeping means, and electronically directed alternative player goals. Exemplars of these functions may be seen with reference to FIGS. 7-10, wherein are provided flow charts demonstrating specific outputs and functionality.

Figure 7:
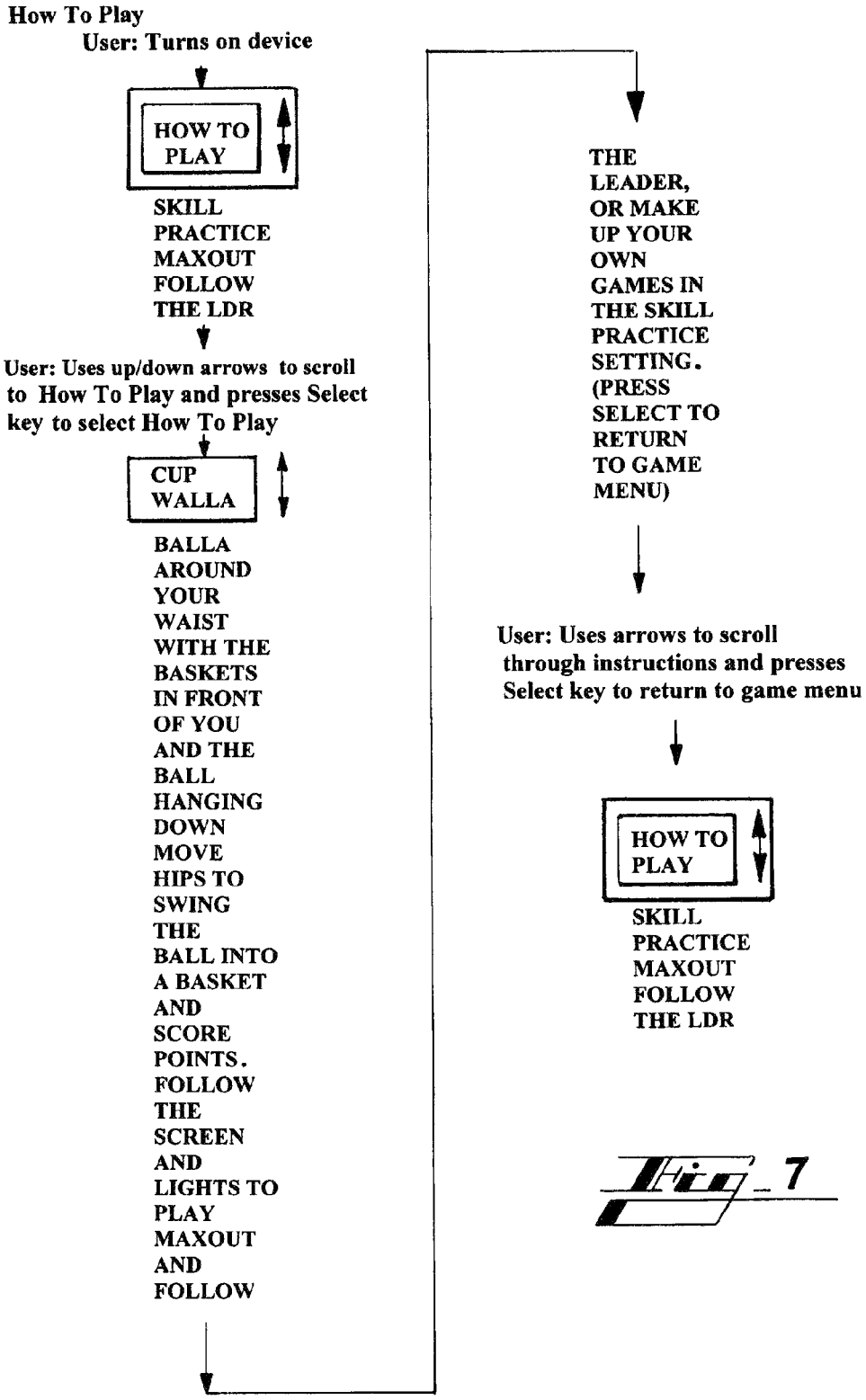
FIG. 7 is a flow diagram demonstrating the electronic logic of the 'How To Play' function of the device shown in FIG. 1.
Figure 8:
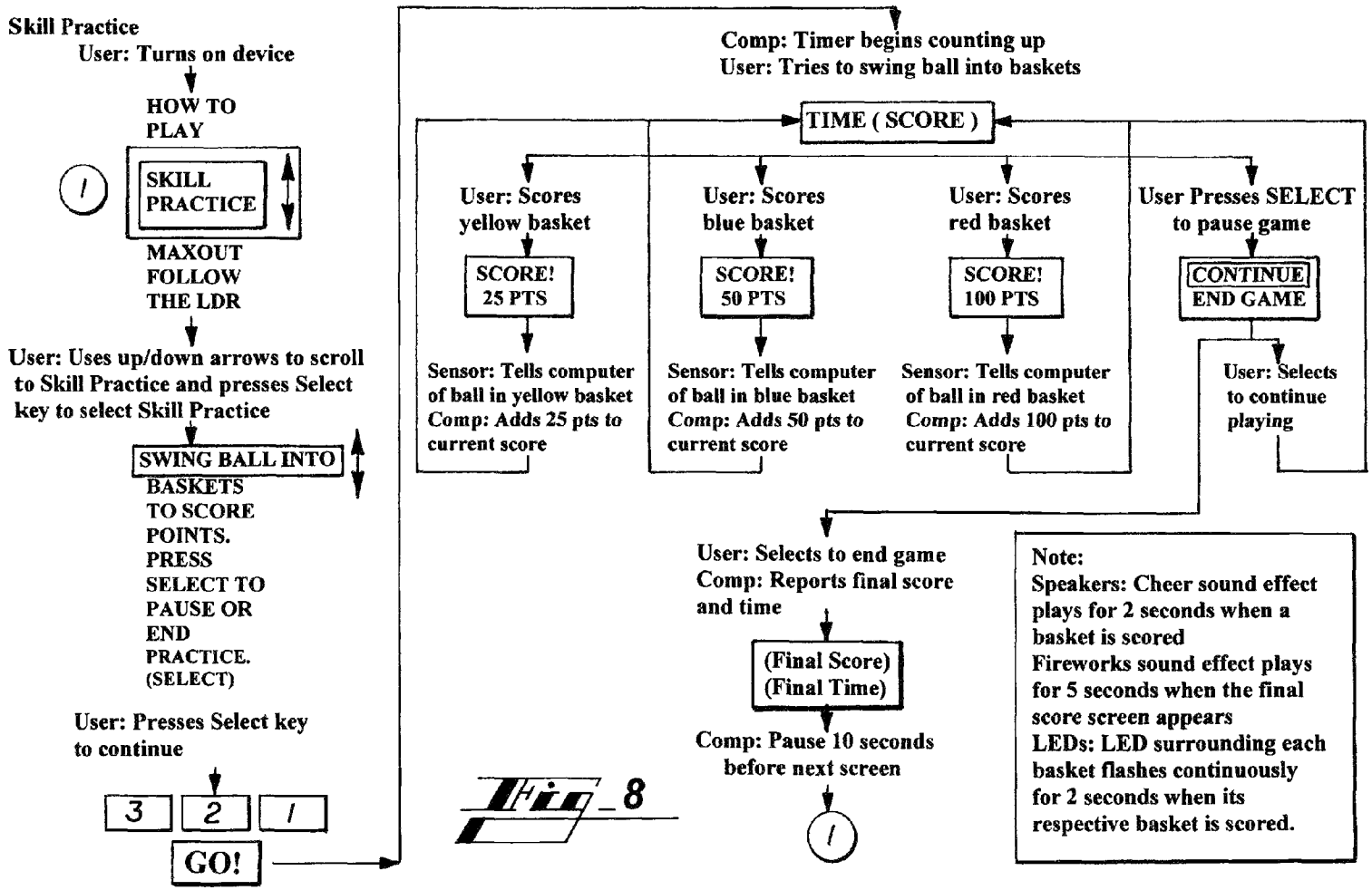
FIG. 8 is a flow diagram demonstrating an electronic logic of the 'Skill Practice' function of the device shown in FIG. 1.
Figure 9:
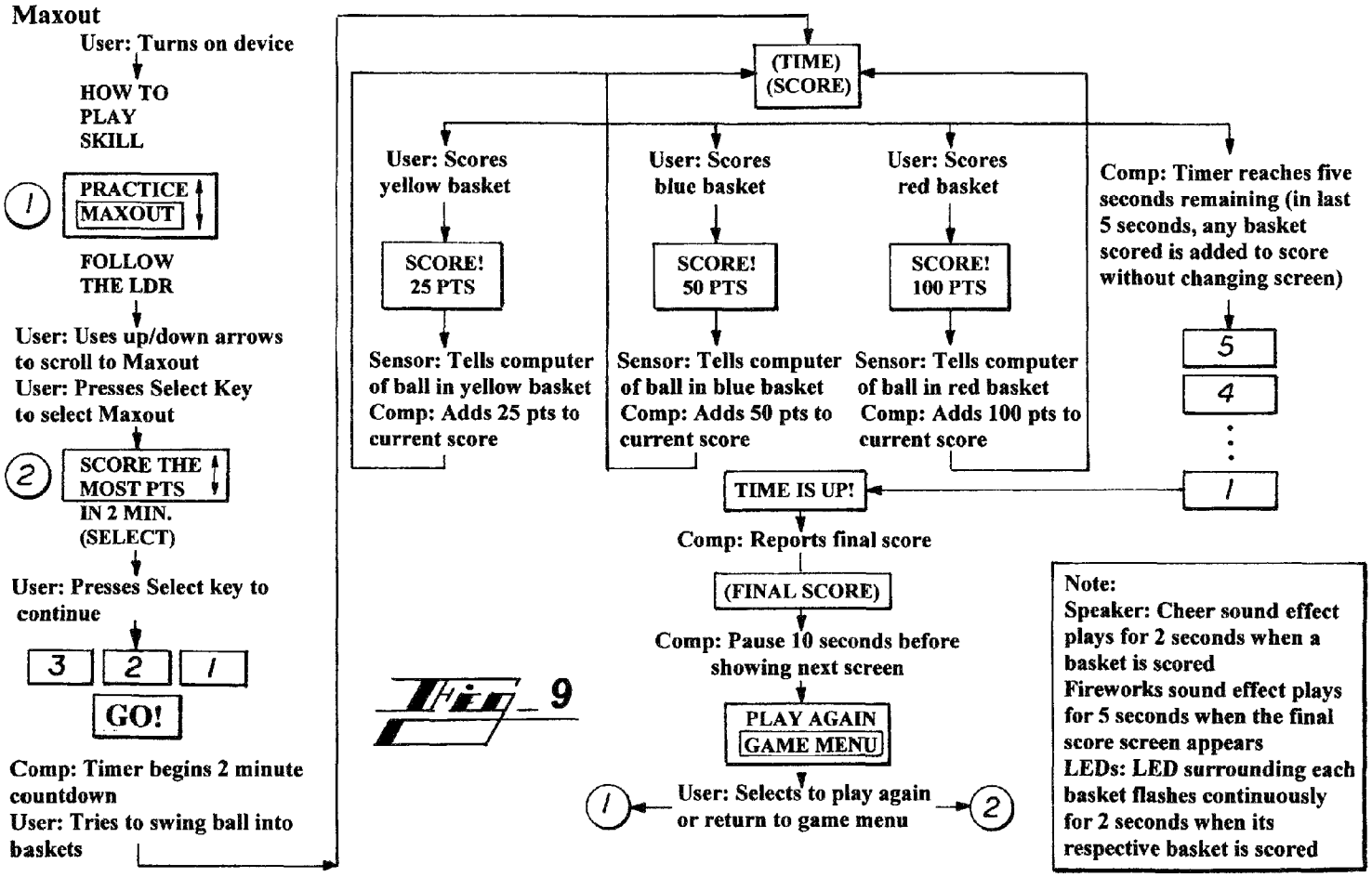
FIG. 9 is a flow diagram demonstrating an electronic logic of the 'Maxout' game function of the device shown in FIG. 1.
Figure 10:
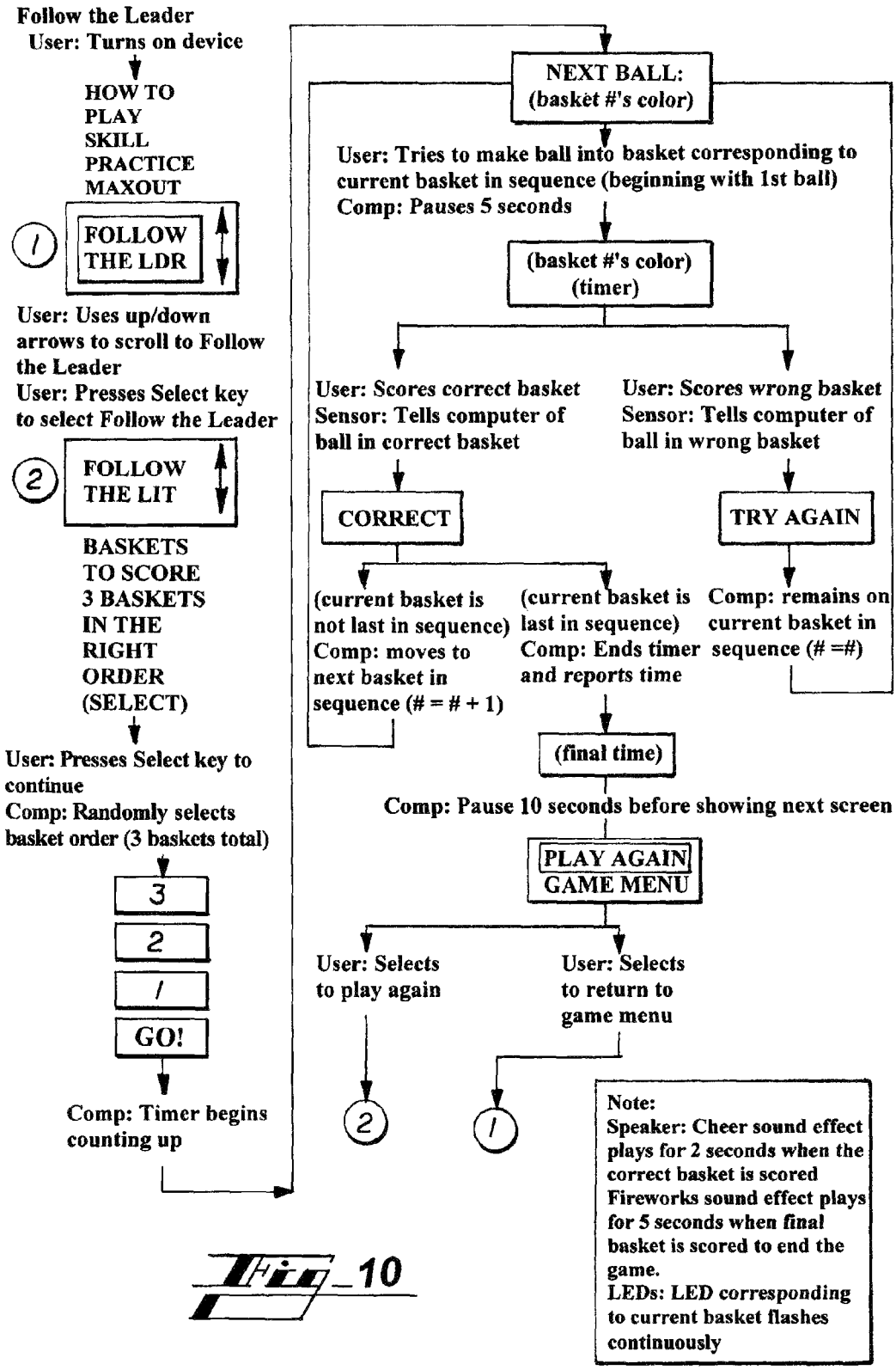
FIG. 10 is a flow diagram demonstrating an electronic logic of the 'Follow the Leader' game function of the device shown in FIG. 1.

Accordingly, electronics module 50 provides a basic play instruction module, best seen with reference to the 'How to Play' diagram of FIG. 7; a skill practice module, best seen with reference to the 'Skill Practice' diagram of FIG. 8; a game module for maximizing a game score in a given time, best seen with reference to the 'Maxout' diagram of FIG. 9; and a game module for target scoring in a defined order, best seen with reference to the 'Follow the Leader' diagram of FIG. 10.

With reference to FIG. 7, a basic play instruction module is provided, wherein a player turns on the device. A menu of options is presented, wherein the player uses control means 72, 74 to scroll to the How to Play selection. The player may then depress control means 70 in order to select the How to Play menu choice. Electronics module 50, through preprogrammed instructions associated with a microprocessor or EPROM device thereof, provides step-wise textual instructions to the player upon display 65. In the case of English language instructions (as shown), the instructions may be provided in marching fashion, to wit, presentation of text from left to right, and scrolling downwardly through the text as the instructions advance in a timed sequence. Alternatively, the player may use control means 72, 74 to advance the instruction text at a pace that is comfortable to the player. Other display presentations will be apparent to those of ordinary skill in the art. When the instructions end, or when the player desires to terminate the instructions, he or she uses control means 70, 72, 74 to return to a game menu.

With reference to FIG. 8, a skill practice module is shown. For use of this module, a player turns on the device, uses control means 72, 74 to scroll to the Skill Practice module. The player then uses control means 70 to select the module. Instructions, such as those shown in FIG. 8, are provided to the player. Upon, pressing control means 70, a countdown timer provides a countdown indication to a start command, such as "GO!" A timer associated with the microprocessor begins counting up, during which time the player attempts to swing ball 19 into a target. Upon successfully landing ball 19 in a target, sensor means 60 provides microprocessor with appropriate target identification, associated with a score, and a score variable is incremented accordingly. Play may then continue until a specific, preprogrammed time is reached, or until the player terminates the game by activation of control means 70. Upon conclusion of the game, a final score is reported upon display 65.

With reference to FIG. 9, a game module for maximizing a game score in a given time is shown. For use of this module, a player turns on the device, uses control means 72, 74 to scroll to the Maxout module. The player then uses control means 70 to select the module. Instructions, such as those shown in FIG. 9, are provided to the player. Upon pressing control means 70, a countdown timer provides a countdown indication to a start command, such as "GO!" A timer associated with the microprocessor begins counting down, during which time the player attempts to swing ball 19 into a target. Upon successfully landing ball 19 in a target, sensor means 60 provides microprocessor with appropriate target identification, associated with a score, and a score variable is incremented accordingly. Play may then continue until time runs out, or until the player terminates the game by activation of control means 70. For added player enjoyment, during a predefined period, for example, the last five seconds of a Maxout game, any baskets scored are added to the score without changing display 65. Similarly, a final countdown of the last five seconds of the game may be provided, and whereupon a concluding sound-effect may be provided. Upon conclusion of the game, a final score is reported upon display 65.

With reference to FIG. 10, a game module for target scoring in a defined order is shown. For use of this module, a player turns on the device, uses control means 72, 74 to scroll to the Follow the Leader module. The player then uses control means 70 to select the module. Instructions, such as those shown in FIG. 10, are provided to the player. Upon pressing control means 70, a countdown timer provides a countdown indication to a start command, such as "GO!" A timer associated with the microprocessor begins counting up, during which time the player attempts to swing ball 19 into a specified target and in a specified order. Upon successfully landing ball 19 in a target, sensor means 60 provides microprocessor with appropriate target identification. If ball 19 lands in the specified target in the defined sequence, the user is notified via display of an indicator such as "CORRECT!", a score variable may be incremented accordingly, and the next target in sequence is indicated to the player. If not, the player may be encouraged to "TRY AGAIN." Play may then continue until time runs out, or until the player terminates the game by activation of control means 70. Upon conclusion of the game, a final score is reported upon display 65.

It is noted that speaker 80 may be activated during play for a defined time, providing, for example, a cheering sound-effect upon scoring, and to provide incentive to the player. Similarly, a sound-effect may be activated upon conclusion of the game when a final score is reported. Yet additionally, to provide further enjoyment and incentive to a player, each target may be provided with a series of light emitting diodes, or the like, surrounding the target to provide visual indicators of successful play, and wherein such visual indicators are activated in any of a variety of patterns upon scoring.

It will therefore be understood by those skilled in the art that the device of the present invention provides a tethered ball and target game wherein the player is provided with means for controlling the tethered ball for greater assurance in causing the ball to be received by the target. Means for controlling and directing the ball in the present invention are made up of generally rigid length 30 of tether member 18 in conjunction with flexible length 31 of tether member 18. Also, it will be noted that the sides of baskets 21 are sloped, and length 30 must be generally between two baskets as is best shown in FIGS. 3 and 4. As a result, the sides of baskets 21 will tend to funnel member 30 into the proper area to be aligned with sighting means 28, 29.

When tether 18 swings forward enough that generally rigid length 30 substantially engages the bottom surface of target plate 12, ball 19 will continue to move up and towards the holes in target plate 12. To provide the greatest assurance of receiving ball 19 within a target of target plate 12, it will be understood that flexible length 31 of tether 18 is of such a length that ball 19 can be just received by target 15 when length 30 is positioned as shown in FIG. 2 of the drawings. If the length of tether 31 allows ball 19 to go beyond target 15, one has a greater chance of missing target 15; and, if length 31 is too short to allow ball 19 to reach target 15, it will of course be understood that ball 19 can never be received by target 15.

The foregoing describes the ratio of length 30 to length 31 but it will be understood that great variety is allowed in the total length of tether 18. The primary limitation is that the total length 18 should be such that ball 19 will not engage the ground when base board is appropriately placed on the player. As a result, a very tall player can utilize a very long tether 18, while a very short player will require a short tether 18. Regardless of the total length of tether 18, the relative lengths of lengths 30 and 31 must be such that ball 19 can be received within the opposite target of target plate 12 when length 30 is placed against the sighting means as illustrated in FIG. 2 of the drawings.

It will therefore be understood that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

What is claimed:

1. A game device comprising:

a target plate;

at least two targets of differing point values carried by the target plate;

a ball;

a tether attaching the ball to the target plate, the tether being sufficiently flexible that the ball can be received by either of the at least two targets, wherein the tether includes a first length that is generally rigid and a second length that is flexible through its length, the first length having a first end that is pivotally fixed to the target plate;

an electronic sensor means associated with a target for detecting receipt of the ball into the target;

an electronic module comprising a preprogrammed microprocessor for directing player activities, wherein the electronic module is preprogrammed to identify each target and a corresponding point value.

2. The game device of claim 1, wherein the electronic module is programmed to perform at least one scoring function.

3. The game device of claim 2, wherein the electronic module further comprises code to perform one or more how-to-play function, skill practice function, maximize game score in a given time function and target scoring in a defined order function.

4. The game device of claim 1, wherein at least one target comprises an electronic sensor means for detecting receipt of the ball into each target.

5. The game device of claim 1, wherein a target is defined by a top opening; the top opening being sized to receive the ball therein.

6. The game device of claim 1, wherein each target comprises a ring defining a central opening, the central opening being of a different size for each target.

7. The game device of claim 1, wherein the first length of the tether is affixed to the target plate along a line extending from the center of one target and through a sighting means.

8. The game device of claim 7, wherein the first length of the tether is long enough to extend from its attachment to a sighting means, and the second length of the tether is long enough to extend from the first length to each target.

9. The game device of claim 1, further comprising: a base hoard, strap means for attaching the base board to a player, and a stem extending from the base board wherein the stem is connected to the target plate.

10. The game device of claim 1, further comprising a user instructional module.

11. The game device of claim 1, further comprising electronic scorekeeping, means, wherein the electronic scorekeeping means is programmed to identify the target and associate a corresponding point value.

12. The game device of claim 1, further comprising a display means.

13. The game device of claim 1, further comprising electronic control means to allow a player to access functions of the microprocessor.

14. The game device of claim 1, further comprising means to deliver one or more preprogrammed sounds to a player, each the sound corresponding to a game event.

15. The game device of claim 1, further comprising means to deliver one or more light displays to a player, the light displays associated with each target, each light display corresponding to a game event.

16. The game device of claim 1, further comprising a coded module comprising player instructions, a countdown timer, and a directed player goal to score as many targets as possible within a pre-defined time.

17. The game device of claim 1, further comprising one or more coded modules comprising player instructions, a countdown timer, and a directed player goal to score a specified target.

18. The game device of claim 17, wherein the directed player goal to score a specified target comprises a series of specified targets in specified order.

19. A game device comprising a target plate; three targets carried by the target plate, each target including, a frustoconical basket having a top opening and a bottom opening, the top opening being, sized to receive the ball therein, the bottom opening, being smaller than the ball for retaining the ball within the basket; a ball; a tether attaching the ball to the target plate, the tether being sufficiently flexible that the ball can be received by at least one target, wherein the tether includes a first length that is generally rigid and a second length that is flexible throughout its length, the first length having a first end that is pivotally fixed to the target plate for allowing approximately universal movement of the first length with respect to the target plate, and a second end opposite from the first end, the second length being fixed to the second end of the first length; a base board; strap means for attaching the base board generally to the waist of a player; and a stem extending, from the base board and carrying the target plate; an electronic module comprising a preprogrammed microprocessor for directing player activities and a user operable menu; an electronic sensor means associated with each the target for detecting receipt of the ball into any one of the targets; an electronic scorekeeping means programmed to identify each target and to associate a corresponding point value thereto; a display means; an electronic control means to allow a player to access functions of the microprocessor; means to deliver one or more preprogrammed sounds to a player, each the sound corresponding to a game event; means to deliver one or more light displays to a player, the light displays associated with each the target, each the light display corresponding to as game event;

and multiple preprogrammed activities for user engagement, the preprogrammed activities comprising a how-to-play module, a skill practice module, a maximize game score in a given time module, and a target scoring in a defined order module.

* * * * *